US006096209A

United States Patent [19]

O'Brien et al.

[11] Patent Number: 6,096,209

[45] Date of Patent: Aug. 1, 2000

[54] THREE MEDIA SILVER RECOVERY APPARATUS

[75] Inventors: Robert O'Brien, Phoenix, Ariz.; Curtis Rhodes, Portageville, N.Y.

[73] Assignees: AWS Industries, L.L.C., Chicago, Ill.; Academy Corporation, Albuquerque, N. Mex.

[21] Appl. No.: 09/200,024

[22] Filed: Nov. 25, 1998

[51] Int. Cl.[7] ..... C22B 11/12

[52] U.S. Cl. ..... 210/266; 210/283; 266/170

[58] Field of Search ..... 210/205, 266, 210/283, 293, 446, 912; 266/170

[56] References Cited

U.S. PATENT DOCUMENTS

| | | | |
|---|---|---|---|
| 3,169,112 | 2/1965 | Nelson | 210/266 |
| 3,655,175 | 4/1972 | Zeleny et al. | 266/22 |
| 3,792,845 | 2/1974 | Larson et al. | 266/22 |
| 4,213,600 | 7/1980 | Thompson, Jr. | 266/170 |
| 4,331,473 | 5/1982 | King, Jr. | 75/109 |
| 4,997,166 | 3/1991 | Wiggins | 266/170 |
| 5,458,024 | 10/1995 | Schiller et al. | 266/170 |
| 5,472,176 | 12/1995 | Azzara | 266/170 |

*Primary Examiner*—David A. Simmons
*Assistant Examiner*—Frank M. Lawrence
*Attorney, Agent, or Firm*—Laff, Whitesel & Saret, Ltd.

[57] ABSTRACT

A silver recovery apparatus is provided for removing silver from waste solutions. The apparatus includes a vessel which defines an internal cylindrical chamber having a transverse cross sectional area. An inlet port is provided at a first end of the vessel and is adapted to receive the waste solution. An outlet port is similarly provided at a location suitable for discharging the waste solution from the vessel once substantially all silver has been removed. A silver replacement core is disposed within the vessel between the inlet and outlet ports. The core substantially fills the transverse cross sectional area of the internal chamber along a longitudinal length of the vessel. The silver replacement core includes sequentially arranged first, second, and third replacement media, wherein each media is composed of a metal which is electropositive relative to silver. The first and third replacement media each have an apparent density lower than that of the second replacement medium.

29 Claims, 1 Drawing Sheet

THREE MEDIA SILVER RECOVERY APPARATUS

BACKGROUND OF THE INVENTION

The present invention relates to an apparatus and process for recovering silver from chemical solutions having silver dissolved therein.

Many chemical processes, most particularly those related to photographic processing, result in waste fluids containing significant amounts of dissolved silver. Because silver is a semiprecious metal, the value of the silver dissolved in such spent photographic processing chemicals is sufficiently high to support efforts to recover the silver prior to disposing of the waste fluid. Furthermore, silver is a regulated substance with limits set as to how much silver may be present in fluids which are discharged into sewage systems. Thus, there is not only an economic incentive to recover the dissolved silver from such spent processing chemicals, but an environmental imperative as well.

A common method for recovering silver from solution has been developed which employs a process of metal replacement wherein a less expensive metal which is higher than silver in the electromotive series, for example iron, replaces the silver in the solution through a chemical reduction reaction. Prior art devices employing this process generally comprise a vessel which houses the replacement metal or medium. The vessel will generally have at least one inlet port for receiving untreated solution, and at least one outlet port for discharging the treated solution from which the dissolved silver has been removed. The replacement medium is arranged within the vessel in a manner that allows the incoming untreated waste solution to pass over the replacement media, allowing the metal replacement to take place. The recovered silver forms a black sludge-like precipitate that tends to collect in the bottom of the vessel, or adhere to the surfaces of the remaining replacement medium. This "black sludge" tends to clog the system, and as it covers more and more surface area of the remaining replacement medium, lowers the efficiency of the silver recovery apparatus.

Channeling is another problem common to prior art silver recovery units. Channeling occurs as the waste fluid being treated consumes the replacement medium. As the replacement medium is consumed by the waste fluid, small voids or channels develop within the medium where the replacement metal has been depleted. Because the effluent flowing through the silver recovery unit will follow the path of least resistance, these channels create preferential flow paths through the silver recovery core allowing the waste fluid to bypass the silver replacement medium. As a result, less silver is removed from the waste solution, and the efficiency of the silver recovery apparatus is reduced. If the number and size of such channels becomes significant, the silver recovery cartridge will be rendered useless.

The prior art discloses numerous examples of silver recovery units. For example U.S. Pat. Nos. 3,630,505 and 3,692,291 to MacKay disclose silver recovery units comprising a vessel housing a porous metal core formed of a coiled metal screen. Many other prior art references such as U.S. Pat. No. 4,740,244 to Williams and U.S. Pat. No. 5,472,176 to Azzara, to name but a few, disclose silver recovery units employing replacement media in the form of steel wool, iron filings, turnings, chips or powder. Each of the media disclosed in this latter group may be characterized as having large surface-to-volume ratios to increase contact between the spent waste fluid and the replacement medium.

U.S. Pat. No. 5,458,024 to Schiller et al. discloses a steel wool silver replacement medium held in place between a pair of non-metal porous pads. Finally, U.S. Pat. No. 5,298,170 to Woog, discloses an effluent neutralization process and chamber wherein silver is removed from spent photographic fixer. This unit includes iron rods disposed within an inlet conduit, which directs incoming fluid down into a mass of steel wool located at the bottom of the chamber. Both the iron rods and the steel wool act as sources of iron to replace the dissolved silver ions. Woog includes a mesh bag containing even more steel wool suspended within the chamber to supply an additional source of iron.

To be viable, a silver recovery unit must efficiently remove silver from the spent waste fluid, reducing the concentration of silver remaining in the treated solution to levels below the minimum desired threshold. Silver discharge is generally regulated at a municipal level and in those jurisdictions where silver discharge is regulated, the allowed concentration of silver discharge is generally limited to less than 5 parts per million (ppm). Further, a silver recovery apparatus must have a reasonably long operating lifetime. Thus, an effective silver recovery unit must remain free from clogging and must effectively remove silver to concentrations below 5 ppm for an extended period of time. The prior art designs generally fail in at least one of these important criteria.

For example, silver recovery units employing only a wound metal screen as the replacement medium are effective at removing large concentrations of silver from solution to bring the silver concentration down to about 200 ppm or higher. However, metal screen media are generally ineffective at "polishing" the fluid to concentrations less than approximately 200 ppm. In contrast, those units employing a more finely divided replacement medium such as steel wool, metal filings, or the like, are effective at removing silver to very low concentrations below about 5 ppm, however, the silver precipitate tends to become enmeshed in the steel wool or other fine media, and tends to clog the device. Channeling is also more prevalent in silver recovery units employing a more finely divided replacement medium.

Another problem which is specific to silver recovery units employed in removing silver from photographic processing waste chemicals is the removal of gelatin from the waste solution. Undeveloped photographic film contains a layer of gelatin which is partially removed during the photographic fixing process. The removed gelatin ends up in the spent photographic fixer solution along with the dissolved silver. When the spent fixer is passed through a silver recovery unit the gelatin tends to deposit or become lodged within the replacement core. Excessive build up of gelatin within the core can interfere with the flow of effluent through the silver recovery unit. Furthermore, as the gelatin becomes embedded in the replacement medium, those portions of the replacement medium covered by the gelatin are effectively blocked from contacting the waste effluent passing through the silver recovery cartridge. Thus, over time a significant amount of the replacement core's surface area is not available for the silver recovery process, lowering the efficiency of the silver recovery unit and shortening the operating life of the device. Therefore an efficient silver recovery unit must provide for the loss of replacement media surface area due to the presence of gelatin, by either providing additional replacement media to compensate for that lost to the gelatin, or removing the gelatin from the solution prior to passing the solution over the replacement media.

In light of the preceding background, there is a need for an improved metal replacement silver recovery unit. It is desirable that such an improved silver recovery unit includes provisions to prevent clogging and channeling within the silver replacement core. It is further desirable that an improved silver recovery unit is designed to increase the longevity of the silver replacement core and efficiently replace silver from waste solutions.

Additional considerations for an effective silver recovery unit include shipping durability and leak resistance. In general, silver recovery units are easily subject to damage during shipping which can cause cracks in the outer vessel, or leakage in and around in the inlet or outlet ports. Thus, an improved silver recovery unit must be designed to include a strong outer vessel to survive unscathed a rough and sometimes hazardous shipping and handling process.

SUMMARY OF THE INVENTION

In light of the background given above, a primary objective of the present invention is to provide an improved silver recovery apparatus as well as an improved process for recovering silver from waste fluids having silver dissolved therein.

Another object of the present invention is to provide a silver recovery unit in which the build up of gelatin within the silver recovery unit does not adversely effect the efficiency of the device.

Yet another object of the present invention is to provide a silver recovery unit which prevents excessive channeling within the metal replacement medium.

Still another object of the present invention is to provide a silver recovery unit having a strong outer vessel capable of withstanding physical abuse in order to survive the rigors of shipping.

An additional object of the present invention is to provide a silver recovery unit which is not prone to leaks.

A still further object of the present invention is to provide a silver recovery unit which prevents the replacement media from contacting oxygen in order to prevent oxidizing the replacement medium.

All of these objects as well as others which will become apparent upon reading the detailed description of the preferred embodiments, are met by the three media silver recovery apparatus and improved process for recovering silver from silver-laden waste fluids, as herein disclosed.

In the preferred embodiment of the invention, a silver recovery apparatus is provided for removing silver from spent photographic processing chemicals. The silver recovery apparatus includes a vessel having an inlet port at a first end, and an outlet port at a second end. The spent photographic processing chemicals flow into the vessel through the inlet port, and are discharged from the vessel through the outlet port after having substantially all of the silver removed therefrom. A silver replacement core is disposed within the vessel, and substantially fills the cross-sectional area thereof. The silver replacement core includes three distinct silver replacement media sequentially arranged along the longitudinal axis of the vessel, such that a first medium substantially fills the cross-sectional area of the vessel over a first longitudinal vessel segment, a second medium substantially fills the cross-sectional area of the vessel over a second longitudinal vessel segment which is adjacent the first vessel segment occupied by the first medium, and a third medium substantially fills the cross-sectional area of the vessel over a third longitudinal vessel segment which is adjacent the second vessel segment occupied by the second medium. Each of the replacement media is formed of a metal which is electropositive relative to silver, such as iron. When the spent photographic processing chemicals contact the replacement media, a metal replacement reaction takes place. The metal comprising the replacement media replaces the silver within the waste solution, and the silver ions form a precipitate within the vessel.

In the preferred embodiment of the invention, the three distinct replacement media are sequentially arranged within the vessel such that the spent photographic processing chemicals will flow through the first, second and third replacement media sequentially. It is further preferred that the first and third replacement media are formed of an identical material having a relatively low density, and the second medium is formed of a material having a relatively high density.

It is also preferred to provide a three dimensionally woven nylon pad adjacent the third filter medium near the outlet port. The three dimensional weave causes the nylon pad to be porous in all directions such that it does not significantly interfere with or redirect the flow of fluid through the silver recovery unit. As the medium is consumed, small pieces may break loose, having the potential to flow toward the top of the vessel where they may contact oxygen. In such cases, the loose pieces of the replacement medium may oxidize, forming a hard sludge which has the potential to block the flow of treated waste fluid out of the silver recovery unit. The nylon pad helps to hold the replacement medium in place, and acts as an oxygen barrier preventing oxidation of the replacement medium.

DETAILED DESCRIPTION OF THE PREFERRED EMBODIMENT

Figure 1:
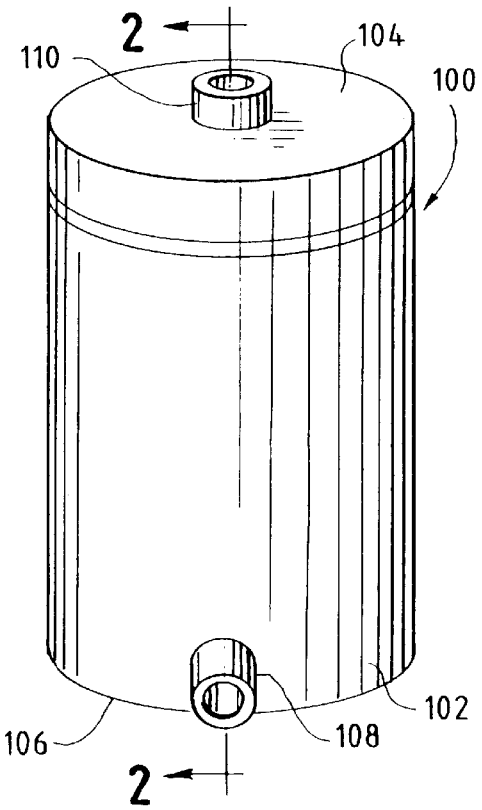
FIG. 1 is a perspective view of a silver recovery apparatus according to the preferred embodiment of the invention.

Referring to FIG. 1, a silver recovery apparatus is shown at 100. Silver recovery apparatus 100 comprises a cylindrical vessel 102 having a top 104 and a bottom 106. The cylindrical shape of vessel 102 is preferred for ease of manufacture, and improved functional characteristics such as strength, though vessels of other shapes may also be used. An inlet port 108 is formed in the sidewall 111 of the vessel near the bottom 106. An outlet port is similarly formed in the diametrical center of the top 104. Inlet port 108 may be threaded to facilitate joining a discharge pipe (not shown) from a photographic processing operation which generates waste effluent containing dissolved silver. Thus, the untreated waste effluent may be introduced into vessel 102 through inlet port 108. Similarly, outlet port 110 may also be threaded to facilitate joining a discharge pipe (also not shown) to remove from the vessel solution from which the dissolved silver has been removed.

Figure 2:
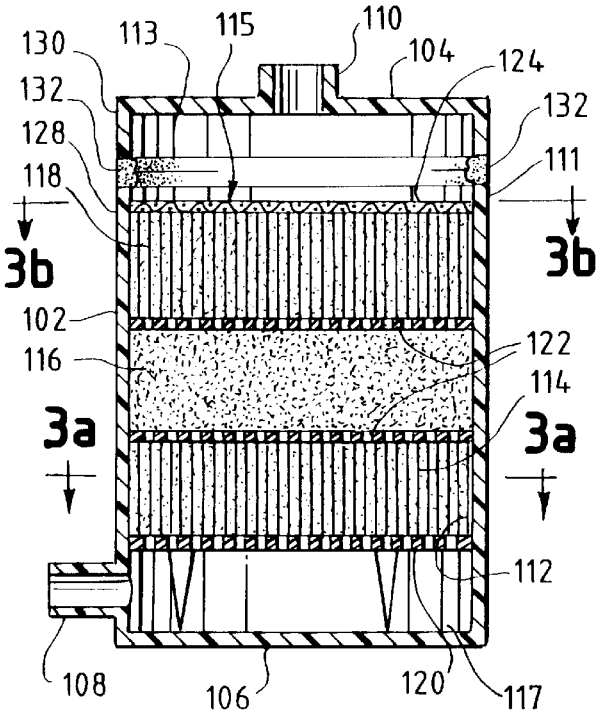
FIG. 2 is a section view of the silver recovery apparatus of FIG. 1, taken along the line 2—2 of FIG. 1.

Turning now to FIG. 2, a silver recovery core 115 is disposed within vessel 102. The silver recovery core 115 primarily comprises first, second and third silver replacement media 114, 116, 118 respectively. Each of the first, second, and third replacement media are formed of a metal which is higher than silver in the electromotive series. In other words, the metal comprising the three media is electropositive relative to silver such that a ready supply of replacement ions is provided for replacing silver in chemical solutions. As can be seen in the drawing, first, second and third media 114, 116, 118 are stacked vertically within vessel and may have rigid plastic grates 122 placed between adjacent media. The plastic grates 122 act as dispersion matrices between the media. A porous plastic support 120 supports the silver recovery core 115 off the bottom of vessel 102, forming a narrow mixing chamber or plenum 117 at the base of the vessel. Lastly, a porous nylon pad 124 is disposed adjacent third replacement medium 114 at the top of silver recovery core 115.

An important aspect of the present invention is the relationships between the three different media, the size of the vessel in which they are housed, and the flow rate of waste fluid through the silver recovery apparatus. In the preferred embodiment, each of the three media is similarly formed of steel wool. However, the characteristics of the steel wool comprising each individual medium vary. Furthermore, while steel wool is preferred, other sources of iron, or other metals electropositive to silver may be substituted. For example, the metal media may be supplied in alternate forms such as, among others, iron or steel filings, machining or stamping scraps, chips or flakes.

Figure 3:
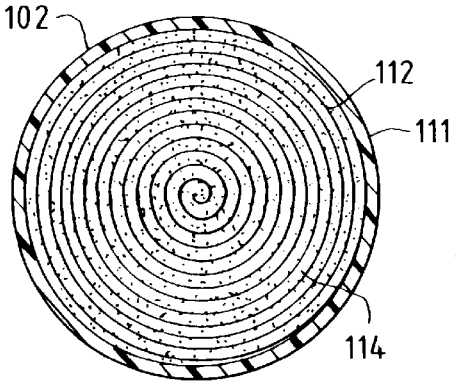
FIG. 3 is a representative cross section taken along either line 3*a*—3*a* or line 3*b*—3*b* of FIG. 2.

The teaming of three different media improves the overall effectiveness of a silver recovery unit. In the preferred embodiment the first and third media 114, 118, comprise wound reels of steel wool, as depicted in the representative cross section of FIG. 3. The second medium 116 comprises finely chopped steel wool disposed between the two reels 114, 118. In this arrangement, the first and third media have generally lower density relative to that of the second. It is preferred that the density of the first and third media corresponds to a surface area to weight ratio of about 102 $mm^2/g$. Furthermore, it is preferred that the first and third media comprise identical reels of steel wool, however it is possible to use different grades of steel wool and to wind one or the other reel more tightly than the other in order to provide two reels with varying characteristics. For example, rather than forming the first and third media 114, 118 identically to one another, it may be desirable to form the first reel into a relatively coarser medium having more porosity than the third medium, or similarly form the first reel into a finer medium to provide greater fiber density of steel wool than the third medium. For example, a more porous medium may correspond to a surface area to weight ratio of about 72 $mm^2/g$.

In the preferred embodiment, vessel 102 comprises a hollow high or low density polyethelene cylinder about 22.5 inches tall with an inner diameter of about 8.37 inches. The vessel is formed as a unitary piece via a rotational molding process. The unitary vessel is then cut open to allow insertion of the silver replacement core. The vessel is formed having extra thick sidewalls approximately 0.250" thick. Conventional PVC silver recovery vessels are formed having sidewalls approximately 0.090" thick. The added thickness of preferred vessel provides superior strength compared to conventional PVC vessels, especially at lower temperatures when PVC tends to become brittle. Prior to being opened, the top and bottom portions of the vessel 128, 130 are marked so that the two separate pieces 128, 130 may be retained as a matched pair, and so that the two pieces may be aligned rotationally when the vessel is closed after the silver replacement core has been inserted therein.

Once the vessel has been opened, the silver replacement core is inserted into the cavity formed in the lower piece 128. In order to prevent surface channeling along the inner surface 112 of the inner wall 111 of vessel 102, the steel wool reels 114, 118 are wound having outer diameters exceeding the inner diameter of vessel 102. An hydraulic piston is employed to press first medium 114 through a funnel shaped fixture (not shown) into vessel 102. Thus, the steel wool reel comprising first medium 114 is compressed between the walls of vessel 102 to form a tight interference fit therewith. The tight fit between wall 111 of vessel 102 prevents waste fluid from flowing along the wall 111 of the vessel, thereby forcing the fluid through the central region of the replacement core 115, and preventing channeling along the sides 111 of the vessel 102.

Once first medium 114 has been pressed into vessel 102, a dispersion matrix 122 in the form of a plastic grate may be placed over the first medium. Next, the chopped steel wool of second filter medium 116 is added above first medium 114. The chopped steel wool comprising second medium 116 is not compressed into vessel 102, but rather vessel 102 is vigorously shaken as the second medium 116 is placed atop first medium 114. This allows the chopped steel wool of second medium 116 to settle into a dense, compacted, evenly distributed mass in the central region of vessel 102.

Upon filling the central region of vessel 102 with chopped steel wool, a second dispersion matrix 122 may be placed atop second filter medium 116. The third medium 118 is then press fit into vessel 102 in the same manner as first medium 114. Nylon pad 124 is then placed atop third medium 118, and the vessel is closed. In closing the vessel 102 the previously marked top and bottom pieces 128, 130 are brought together and rotationally aligned according to the previous markings. Once aligned, the two pieces 128, 130 are welded via a thermal molecular process along seam 132. The extra thickness in the vessel sidewalls 111 and the strength of seam 132 provide an extra strength silver recovery vessel capable of surviving extremely rough handling during shipping. The added strength is also important during the operation of the silver recovery unit. During the silver recovery process, the replacement core tends to expand, exerting outward pressure on the sides of the vessel. The added thickness of sidewalls 111 and the strength of weld 132 assure that the vessel will accommodate the swelling of the silver replacement core throughout the operational life of the unit.

Turning to the silver replacement core itself, acceptable ranges for the average strand diameter, surface to volume ratio, apparent density, and mass of the first, second and third filter media 114, 116, 118 are as follows. For the first and third media 114, 118, the average diameter of the steel wool strands should be in the range between 0.001" and 0.006" with 0.0025" preferred. This corresponds generally with commercially available grade two steel wool. The steel wool comprising first and second filter media 114, 116 are wound to a tightness corresponding to an apparent density between 30 lb/cu. ft. and 40 lb/cu. ft., with 35 lb/cu. ft. preferred. The tightness with which the steel wool is wrapped, the strand length, and average strand diameter combine to produce first and third media having surface-to-volume ratios in the range between about 1500 $ft^2/ft^3$, and 2000 $ft^2/ft^3$ with 1750 $ft^2/ft^3$ preferred. In the preferred embodiment wherein the vessel 102 has about an 8.37 inch inner diameter, it is preferred that the first and third filter media each comprise a total of 5 lbs. steel wool.

With regard to the chopped steel wool comprising second filter medium 116 the average diameter of the steel wool strands should be in the range between 0.001" and 0.006", with 0.005" preferred. Further, second medium steel wool 116 is chopped such that the average strand length is between 0.02" and, 0.2" with 0.1" preferred. Upon compacting the chopped steel wool into vessel 102 second filter medium 116 should have an apparent density in the range between 40 lb/ft$^3$ and 45 lb/ft$^3$ with 42 lb/ft$^3$ preferred. With the 8.37" diameter vessel of the preferred embodiment, second filter medium 116 comprises 6 lbs. chopped steel wool.

In operation, waste effluent from a photographic developing process or some other process that generates large volumes of solution having silver dissolved therein is caused to flow into vessel 102 through inlet port 108. Preferably vessel 102 is oriented as shown in FIG. 2 such that waste fluids enter at the bottom of vessel 102 and flow upwards toward the top of silver recovery unit 100. As waste fluid enters vessel 102 it is evenly dispersed throughout plenum area 117. As the fluid volume introduced into vessel 102 increases, the waste fluid sequentially seeps upward through first filter medium 114, second filter medium 116, and third filter medium 118, then finally through nylon pad 124. Upon reaching the level of outlet port 110 the filtered solution is discharged from vessel 102.

As the waste fluid passes through the first, second and third filter media 114, 116, 118 various filtering steps occur. Initially, first filter medium 114 acts to trap gelatin, preventing the gelatin from entering and clogging the more finely divided second medium 116. Because first filter medium is relatively open, the accumulation of gelatin therein has a less pronounced effect on the flow of waste fluid through silver recovery unit 100, than if the gelatin were allowed to accumulate on the more dense second medium 116. Further, although first filter medium 114 is open relative to second filter medium 116, it nonetheless presents a dense tangle of intertwined steel fibers which represent a significant obstacle to the free flow of fluid through the silver recovery core 115. The tortuous nature of the flow path through first filter medium 114 helps to evenly disperse the fluid before it enters the more finely divided second filter medium 116 thereby preventing channeling in the second medium. Thus, first filter medium 114 filters the gelatin, disperses the fluid flow, and acts as a preliminary source of iron to begin the silver replacement process.

The majority of the silver replacement takes place within the first and second filter medium 116. The finely chopped steel wool comprising the second medium has no structural integrity. Therefore, loose steel wool fibers tend to drop into and fill any voids within the medium. Thus, the second medium presents a dense, nearly impenetrable mass of steel wool fibers through which the waste fluid must tortuously negotiate its way on its journey through silver recovery unit 100. This, combined with the relatively large surface-to-volume ratio of second media fibers themselves, ensures that the waste fluid will contact the steel wool at some point on its way through the second medium 116. The rigorous filtering action of second medium 116 is such that substantially all of the silver dissolved in the waste solution will be removed upon the waste solution passing through the second medium 116.

Finally, the third medium 118 acts as a final polishing step for removing any stray silver ions which may have managed to slip through the finely chopped steel wool of second medium 116. The third medium 118 also acts to hold the chopped steel wool in place.

The nylon pad 124 placed above the third medium 118 prevents the steel wool from oxidizing and possibly clogging the discharge outlet. If an air bubble forms at the top of vessel 102, nylon pad 124 acts to suppress individual strands of steel wool of third medium 18 from protruding above the fluid level within the vessel. Thus, nylon pad 124 serves as a barrier against oxidation helping to protect the outlet 110 and any exterior plumbing connected thereto from becoming clogged.

Figure 4:
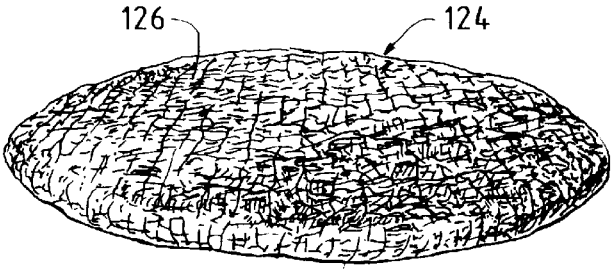
FIG. 4 is a perspective view of a nylon pad employed in the preferred embodiment of the silver recovery apparatus of FIGS. 1 and 2.

As can be seen in FIG. 4, nylon pad 124 is imparted with a three-dimensional weave of individual nylon fibers 126 such that the pad is porous in all directions. For example, nylon pad 124 may comprise a tubular TRILOR 3 beam media. The three-dimensional nature of the weave allows fluid to flow in multiple directions, laterally as well as vertically, as it passes through the pad. Therefore, the pad does not significantly hinder the flow of fluid through the silver recovery unit 100.

EXAMPLE

A prototype of the invention according to the preferred embodiment described above was constructed and tested by Academy Corp., assignee of the present patent application. The vessel comprised a 8.37" diameter cylinder 22.5" tall. First and third media comprised 5 lbs. wound steel wool reels having a surface-to-volume ratio of 35 lb/ft$^3$. The second medium comprised chopped steel wool having average strand length of 0.1 " and average diameter strands of 0.003". The second medium comprised 6 lbs. steel wool. Processing waste fluids containing silver concentrations of approximately 2 grams per liter, the silver recovery apparatus successfully processed approximately 3,000 liters of solution, removing silver to concentrations below 1 ppm.

It should be noted that various changes and modifications to the present invention may be made by those of ordinary skill in the art without departing from the spirit and scope of the present invention which is set out in more particular detail in the appended claims. Furthermore, those of ordinary skill in the art will appreciate that the foregoing description is by way of example only, and is not intended to be limiting of the invention as described in such appended claims.

What is claimed is:

1. An apparatus for removing silver from fluids having silver dissolved therein, the apparatus comprising:

a container having first and second ends with an inlet port provided at the first end, and an outlet port provided at the second end, the container enclosing an axial bore extending between the inlet and outlet ports and defining a transverse cross sectional area;

first, second, and third silver replacement media disposed within the bore substantially filling the transverse cross sectional area along a length of the bore, the media being sequentially arranged along the length of the bore such that the first medium is nearest the inlet port, the third medium is nearest the outlet port, and the second medium being disposed therebetween, each replacement medium comprising a metal which is electropositive relative to silver, and wherein said first and third replacement media each have a lower surface area-to-volume ratio than that of said second replacement medium.

2. The apparatus of claim 1 further comprising a porous nylon pad disposed between the third medium and the outlet port.

3. The apparatus of claim 1 wherein said first and third silver replacement media comprise steel wool wound into circular reels having outer diameters compressed to be substantially equal to an inner diameter of said bore.

4. The apparatus of claim 1 wherein the second medium comprises finely chopped steel wool disposed between said first and third replacement media.

5. The apparatus of claim 2 wherein said nylon pad comprises a three-dimensional three beam weave such that said pad is porous in all directions.

6. The apparatus of claim 1 further comprising a porous support raising said first medium from the first end of said container to form a dispersion plenum adjacent the inlet port.

7. The apparatus of claim 6 wherein said container comprises a cylindrical vessel formed of low density polyethylene.

8. The apparatus of claim 6 wherein said container comprises a cylindrical vessel formed of high density polyethylene.

9. The apparatus of claim 8 wherein said vessel comprises a unitary vessel formed by a rotational molding process, and wherein said unitary vessel is cut open to form a top piece and a bottom piece to allow insertion of said first, second, and third silver replacement media.

10. The apparatus of claim 9 wherein said top and bottom pieces are joined by a thermal molecular bond.

11. The apparatus of claim 10 further comprising a vessel having sidewalls approximately 0.250" thick.

12. The apparatus of claim 1 wherein said container is arranged vertically such that said inlet port is positioned near a bottom end of the container, and fluid introduced into said container is forced to flow in an upward direction through said first, second, and third replacement media toward said outlet port positioned near a top end of the container.

13. The apparatus of claim 3 wherein the second medium comprises finely chopped steel wool disposed between said first and third steel wool reels.

14. An apparatus for removing silver from fluids having silver dissolved therein, the apparatus comprising:

a container having first and second ends with an inlet port provided at the first end, and an outlet port provided at the second end, the container enclosing an axial bore extending between the inlet and outlet ports and defining a transverse cross sectional area;

first, second, and third silver replacement media disposed within the bore substantially filling the transverse cross sectional area along a length of the bore, the media being sequentially arranged along the length of the bore such that the first medium is nearest the inlet port, the third medium is nearest the outlet port, and the second medium being disposed therebetween, wherein said first and third silver replacement media comprise steel wool wound into circular reels having outer diameters compressed to be substantially equal to an inner diameter of said bore, wherein the second medium comprises finely chopped steel wool disposed between said first and third steel wool reels.

15. The apparatus of claim 14 wherein the wound reels comprising the first and third media comprise identical grade steel wool having identical average diameter strands and identical apparent densities.

16. The apparatus of claim 15 wherein said second silver replacement medium comprises chopped steel wool having average diameter strands larger than the average diameter strands of the steel wool comprising said first and third media, and wherein the steel wool is chopped to an average strand length equal to approximately 0.1".

17. A silver recovery apparatus for removing silver from spent photographic processing chemicals, the apparatus comprising:

a vessel defining an internal cylindrical chamber having a transverse cross sectional area;

an inlet port disposed at a first end of the vessel adapted to receive said spent photographic processing chemicals;

an outlet port disposed at a second end of the vessel positioned to discharge said chemicals from said vessel upon removal of substantially all silver therefrom; and a silver replacement core disposed within said vessel between said inlet and outlet ports, the core substantially filling the transverse cross sectional area of said internal chamber along a longitudinal length of said vessel, said core comprising sequentially arranged first, second, and third silver replacement media, each media comprising a metal which is electropositive relative to silver, and wherein said first and third replacement media each have a lower surface area-to-volume ratio than that of said second replacement medium.

18. The silver recovery apparatus of claim 17 wherein said first and third replacement media are substantially identical.

19. The silver recovery apparatus of claim 18 wherein the first and third replacement media comprise tightly wound reels of steel wool having approximately 0.0025" average diameter strands.

20. The silver recovery apparatus of claim 19 wherein the second replacement medium comprises finely chopped steel wool having approximately 0.005" average diameter strands and wherein said strands are chopped to an average length of approximately 0.1".

21. The silver recovery apparatus of claim 17 wherein said vessel is positioned vertically such that the inlet port is located near a bottom end of the vessel, and the outlet port is positioned near a top end of the vessel such that in operation said fluid flows from the bottom of the vessel to the top of the vessel.

22. The silver recovery apparatus of claim 17 further comprising a porous synthetic pad disposed between the outlet port and replacement core.

23. The silver recovery apparatus of claim 22 wherein said synthetic pad comprises a three dimensional woven pattern such that the pad is porous in all directions such that fluid may flow transversely through the pad as well as longitudinally.

24. A silver recovery apparatus for removing silver from a liquid solution comprising:

a vessel having an inlet port positioned near a base of said vessel, and an outlet port located in the top of said vessel;

a first filter medium contained within said vessel, spaced above the base and above the inlet port, substantially filling a first horizontal cross section of said vessel;

a second filter medium contained within said vessel, positioned above said first filter medium, and substantially filling a second horizontal cross section of said vessel; and a third filter medium contained within said vessel, positioned above said second filter medium, and substantially filling a third horizontal cross section of said vessel;

each filter medium comprising a metal which is electropositive relative to silver, and wherein said first and third filter media each have a lower surface area-to-volume ratio than that of said second filter medium.

25. The silver recovery apparatus of claim 24 wherein the third filter medium is substantially identical to the first filter medium.

26. The silver recovery apparatus of claim 24 further comprising a porous nylon pad disposed between the outlet port and the third filter medium.

27. The silver recovery apparatus of claim 24 wherein the first filter medium comprises wound steel wool having an apparent density equal to approximately 35 $lb/ft^3$.

28. The silver recovery apparatus of claim 24 wherein the second filter medium comprises chopped steel wool having an apparent density equal to approximately 42 $lb/ft^3$.

29. The silver recovery apparatus of claim 28 wherein the third filter medium is substantially identical to the first filter medium.

* * * * *